US008974021B2

(12) United States Patent
Yazawa et al.

(10) Patent No.: US 8,974,021 B2
(45) Date of Patent: Mar. 10, 2015

(54) PRINTING APPARATUS AND PROCESSING METHOD THEREOF

(71) Applicant: Canon Kabushiki Kaisha, Tokyo (JP)

(72) Inventors: Takeshi Yazawa, Yokohama (JP); Yuji Konno, Kawasaki (JP); Hinako Ojiro, Wynnewood, PA (US); Masashi Hayashi, Yokohama (JP); Toshiyuki Chikuma, Tokyo (JP); Hirokazu Tanaka, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/339,813

(22) Filed: Jul. 24, 2014

(65) Prior Publication Data

US 2015/0015640 A1 Jan. 15, 2015

Related U.S. Application Data

(63) Continuation of application No. 13/604,253, filed on Sep. 5, 2012, now Pat. No. 8,814,296.

(30) Foreign Application Priority Data

Oct. 11, 2011 (JP) ..... 2011-224307

(51) Int. Cl.
*B41J 29/38* (2006.01)
*B41J 25/00* (2006.01)
(Continued)

(52) U.S. Cl.
CPC *B41J 25/001* (2013.01); *B41J 2/01* (2013.01); *B41J 19/96* (2013.01)
USPC ..... 347/9; 347/13; 347/42; 347/57

(58) Field of Classification Search
CPC ..... B41J 25/001; B41J 2/01; B41J 19/36
USPC ..... 347/9, 12–14, 40, 42, 56–57
See application file for complete search history.

(56) References Cited

U.S. PATENT DOCUMENTS 6,789,867 B2 9/2004 Takahashi et al.
7,048,354 B2 5/2006 Kawatoko et al.
(Continued)

FOREIGN PATENT DOCUMENTS

CN 1535826 A 10/2004
CN 1872553 A 12/2006
(Continued)

OTHER PUBLICATIONS

Chinese Office Action issued in counterpart application No. 201210385065.3 dated May 29, 2014, along with its English-language translation—18 pages.

*Primary Examiner* — Juanita D Jackson
(74) *Attorney, Agent, or Firm* — Fitzpatrick, Cella, Harper & Scinto

(57) ABSTRACT

A printing apparatus comprising, a printhead including an element array in which a plurality of printing elements are arrayed, scanning unit configured to reciprocally scan the printhead, driving unit configured to time-divisionally drive the printing elements, conveyance unit configured to convey a printing medium, and setting unit configured to set a driving order, wherein the conveyance unit performs a first conveyance operation of conveying the printing medium by a conveyance amount which is an integer multiple of a width of the group of the time-divisional driving, and a second conveyance operation of conveying the printing medium by a conveyance amount which is not an integer multiple of the width of the group, and the setting unit sets the driving order in the time-divisional driving for each scan based on the conveyance amount by the conveyance unit.

18 Claims, 14 Drawing Sheets

(51) Int. Cl.
*B41J 2/01* (2006.01)
*B41J 19/96* (2006.01)

(56) References Cited

U.S. PATENT DOCUMENTS

| | | | | |
|---|---|---|---|---|
| 7,287,832 | B2 | 10/2007 | Hayasaki | |
| 7,357,483 | B2 | 4/2008 | Ide et al. | |
| 7,360,856 | B2 | 4/2008 | Ochiai et al. | |
| 7,472,977 | B2 * | 1/2009 | Fujimoto et al. | 347/13 |
| 7,600,839 | B2 | 10/2009 | Akama et al. | |
| 8,184,342 | B2 | 5/2012 | Hirosawa et al. | |
| 2004/0201639 | A1 | 10/2004 | Hayasaki | |
| 2006/0119632 | A1 | 6/2006 | Ochiai et al. | |
| 2006/0274097 | A1 | 12/2006 | Fujimoto et al. | |
| 2007/0153036 | A1 | 7/2007 | Akama et al. | |
| 2009/0002777 | A1 | 1/2009 | Hirosawa et al. | |
| 2011/0134177 | A1 | 6/2011 | Konno et al. | |

FOREIGN PATENT DOCUMENTS

| | | | |
|---|---|---|---|
| CN | 1990243 | A | 7/2007 |
| CN | 101332701 | B | 9/2010 |
| JP | 2006-159698 | A | 6/2006 |

* cited by examiner

PRINTING APPARATUS AND PROCESSING METHOD THEREOF

The present application is a continuation of U.S. application Ser. No. 13/604,253, filed on Sep. 5, 2012, now U.S. Pat. No. 8,814,296, which claims priority to JP 2011-224307, filed Oct. 11, 2011, the entire disclosure of each of which is incorporated by reference herein.

BACKGROUND OF THE INVENTION

1. Field of the Invention

The present invention relates to a printing apparatus and processing method thereof.

2. Description of the Related Art

There is known a printing apparatus which employs an inkjet method of printing an image on a printing medium using a printhead including orifice arrays each configured by arraying a plurality of printing elements (orifices) (integrating and arraying many printing elements). As printing apparatuses of this type require higher printing operation speeds and higher resolutions, the number of orifices arrayed on a printhead is increasing.

When all printing elements are simultaneously driven in a printing operation, discharge becomes unstable owing to pressure interference (crosstalk) between neighboring orifices, and the like. Since a large current is supplied, a voltage drop arising from power loss on a common power line becomes large near the printhead. As the number of simultaneously driven orifices increases, driving voltage applied to orifices (printing elements) drops more steeply, impairing the printing stability. Further, a power supply instantaneously resistant to a large current is necessary, inhibiting the design of a compact, low-cost apparatus.

To solve these problems, all orifices are generally divided into a plurality of driving blocks in a printhead, and orifices in the respective driving blocks are time-divisionally driven sequentially. This driving method is called time divisional driving (or block divisional driving).

When a printhead in which printing elements are arranged on a single straight line is time-divisionally driven for respective driving blocks, the printing position shifts between the driving blocks because the printhead moves in the scanning direction during the time divisional driving. For example, when expressing tonality using a unit matrix (an image processing control unit formed from M×N pixels), a dot pattern in the matrix may shift in every printing scan of the printhead in accordance with the relationship between the matrix size and the pattern size of the driving block. To solve this problem, Japanese Patent Laid-Open No. 2006-159698 proposes a method of shifting the arrangement of binary image data in every printing scan of the printhead in accordance with the relationship between the matrix size and the pattern size of the driving block.

Conventional printing by time divisional driving suffers the following problem regardless of whether to express tonality using a unit matrix.

FIG. 13 is a view showing the relationship between the orifice array of a printhead, the driving signal of each orifice, and a dot which is discharged from each orifice and attached to a printing medium. FIG. 13 shows 2-pass printing (that is, in which an image is printed by two printing scans) in the same printing region on a printing medium.

In this case, every time a printing scan is performed, the printing medium is conveyed by a distance corresponding to eight orifices. Reference numeral 401 denotes a first printing scan; 402 and 412, a second printing scan; and 403 and 413, a third printing scan.

An orifice array denoted by reference numeral 402 is illustrated at a position shifted from an orifice array denoted by reference numeral 401 by eight orifices in the orifice array direction (printing medium conveyance direction). This is because in the second printing scan, the printing medium is conveyed in the conveyance direction by a distance corresponding to eight orifices from a position in the first printing scan. Similarly, an orifice array denoted by reference numeral 403 is illustrated at a position shifted along with conveyance of the printing medium.

An orifice array 500 of the printhead is divided into two, groups 1 and 2 each including eight adjacent orifices, as denoted by reference numerals 401 to 403. Each of eight orifices in each group belongs to one of eight driving blocks. In a printing operation, the eight orifices are time-divisionally driven for the respective driving blocks (orifices of the same driving block are driven simultaneously). Note that numerals on the left side of respective orifices indicate orifice numbers 1-1 to 2-8, and numerals on the right side of respective orifices indicate block numbers 1 to 8.

In the orifice array 500, the first and ninth orifices 1-1 and 2-1 from the top in FIG. 13 are assigned to the first driving block. The second and 10th orifices 1-2 and 2-2 from the top in FIG. 13 are assigned to the second driving block. All orifices are assigned to driving blocks. The first to eighth driving blocks are sequentially driven in the ascending order based on a pulse-like block selection signal 300 as denoted by reference numerals 411 to 413, and a printing signal complying with image data. Then, ink is discharged from the respective orifices, forming dots on a printing medium, as denoted by reference numeral 414.

As the layout positions of dots formed on a printing medium, dots are formed in a staggered pattern in the first scan (first scanning), and dots are formed in an inverse staggered pattern in the second printing scan (second scanning) in the same printing region, as denoted by reference numeral 414. Printing of an image is completed by 2-pass printing.

To the contrary, FIG. 14 shows printing using only a predetermined number (eight in this case) of orifices positioned at the center, unlike printing using all orifices in FIG. 13. For example, an orifice array denoted by reference numeral 601 prints using orifices 1-5 to 1-8 and 2-1 to 2-4. Note that the arrangement of the printhead and original image data are the same as those in FIG. 13.

A comparison between dot layout positions denoted by reference numeral 414 in FIG. 13 and those denoted by reference numeral 616 in FIG. 14 reveals that they are different from each other, though original image data is the same.

More specifically, dots are laid out with almost no gap on a printing medium at dot layout positions denoted by reference numeral 414 in FIG. 13. In contrast, gaps are generated between dots at dot layout positions denoted by reference numeral 616 in FIG. 14. This dot layout position difference is generated because all dots are formed by the same driving blocks in FIG. 13, whereas dots formed by different driving blocks coexist in FIG. 14.

When a region printed using all orifices and a region printed using only some orifices exist, the relationship between the printing medium conveyance amount and the driving block cycle changes, and fill of dots differs between the respective regions. This appears as density nonuniformity, degrading image uniformity.

SUMMARY OF THE INVENTION

The present invention has been made to overcome the conventional problems, and provides a technique advantageous for suppressing a density change arising from the relationship between the driving block and the printing medium conveyance amount in time divisional driving, and suppressing a decrease in image uniformity.

One of the aspects of the present invention provides a printing apparatus comprising, a printhead including an element array in which a plurality of printing elements are arrayed, scanning unit configured to reciprocally scan the printhead in a direction perpendicular to an array direction of the printing elements, driving unit configured to divide the element array into a plurality of groups each including consecutive printing elements, and time-divisionally driving the printing elements in each group, conveyance unit configured to convey a printing medium in the array direction of the printing elements, and setting unit configured to set a driving order in the time divisional driving, wherein the conveyance unit performs a first conveyance operation of conveying the printing medium by a conveyance amount which is an integer multiple of a width of the group, and a second conveyance operation of conveying the printing medium by a conveyance amount which is not an integer multiple of the width of the group, and the setting unit sets the driving order in the time divisional driving for each scan based on the conveyance amount by the conveyance unit.

Further features of the present invention will become apparent from the following description of exemplary embodiments with reference to the attached drawings.

DESCRIPTION OF THE EMBODIMENTS

Preferred embodiments of the present invention will now be described in detail with reference to the accompanying drawings. In the following description, a printing apparatus using an inkjet printing method will be exemplified. The printing apparatus may be, for example, a single-function printer having only a printing function, or a multifunction printer having a plurality of functions including a printing function, FAX function, and scanner function. Also, the printing apparatus may be, for example, a manufacturing apparatus used to manufacture a color filter, electronic device, optical device, micro-structure, and the like using a predetermined printing system.

In the following description, "print" not only includes the formation of significant information such as characters and graphics, but also broadly includes the formation of images, designs, patterns, structures, and the like on a printing medium, or processing of the medium, regardless of whether they are significant or insignificant and whether they are so visualized as to be visually perceived by humans.

Also, a "printing medium" not only includes paper used in general printing apparatuses, but also broadly includes materials capable of accepting ink, such as cloth, plastic film, metal plate, glass, ceramics, resin, wood, and leather.

Also, "ink" should be broadly interpreted, similar to the definition of "print" described above. "Ink" includes a liquid which, when applied onto a printing medium, can form images, designs, patterns, and the like, can process the printing medium, or can be used for ink processing (for example, solidification or insolubilization of a coloring material contained in ink applied to a printing medium).

Further, a "printing element" (to be also referred to as a "nozzle") generically unit an ink orifice or a liquid channel communicating with it, and an element for generating energy used to discharge ink, unless otherwise specified.

Figure 1A:
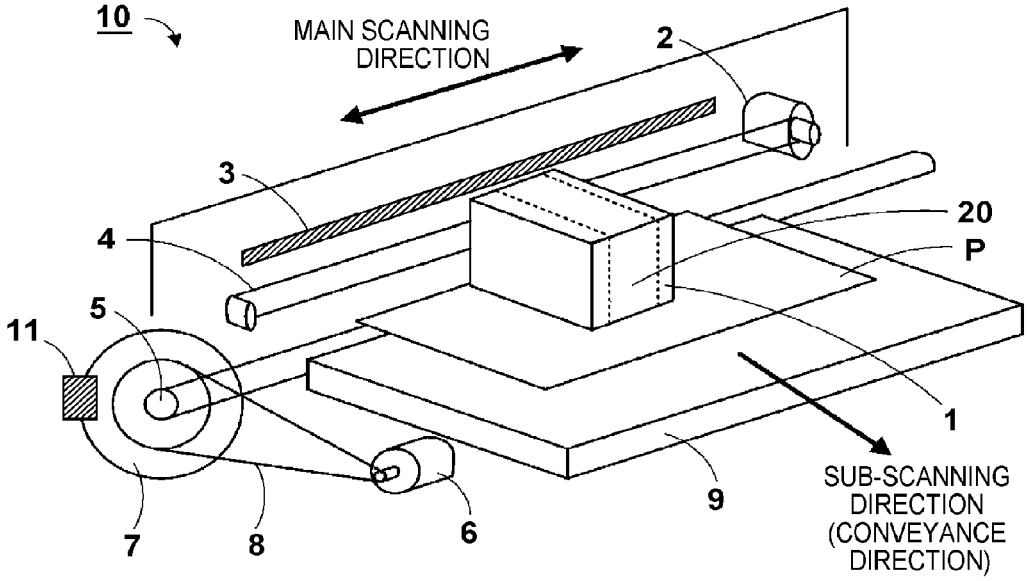
FIGS. 1A and 1B are views exemplifying the arrangement of a printing apparatus 10 according to an embodiment of the present invention.

FIG. 1A is a view exemplifying the overall arrangement of a printing apparatus 10 according to an embodiment of the present invention.

In the printing apparatus 10, an inkjet printhead (to be referred to as a printhead hereinafter) 20 which prints by discharging ink according to the inkjet method is mounted on a carriage 1. The carriage 1 reciprocates in a predetermined direction (the main scanning direction) to print. The printing apparatus 10 conveys a printing medium P such as a printing sheet in a direction (the sub-scanning direction) perpendicular to the main scanning direction. The printing apparatus 10 prints by discharging ink from the printhead 20 to the printing medium P.

The carriage 1 receives the rotational force of a carriage motor (driving source) 2 via a belt 4. The carriage 1 can therefore reciprocate on a chassis 9. The printing apparatus 10 drives the carriage motor 2 while an encoder light-receiving unit 11 detects the displacement amount of a linear encoder 3, thereby controlling the position of the carriage 1.

The printing apparatus 10 rotates a conveyance roller 5 to convey the printing medium P in the sub-scanning direction. The conveyance roller 5 rotates upon receiving the rotational force of a conveyance motor 6 via a belt 8. The printing apparatus 10 drives the conveyance motor 6 while the encoder light-receiving unit 11 detects the angular displacement of a rotary encoder 7 attached to the conveyance roller 5. By this operation, the rotational amount of the conveyance roller 5 is controlled, and the conveyance amount of the printing medium P is controlled.

Figure 1B:
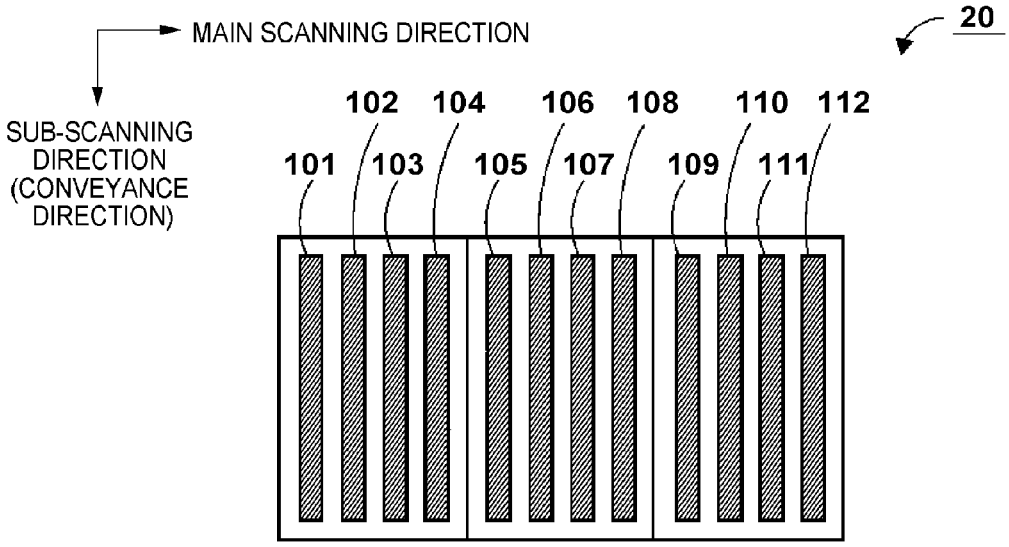
Figure 12:
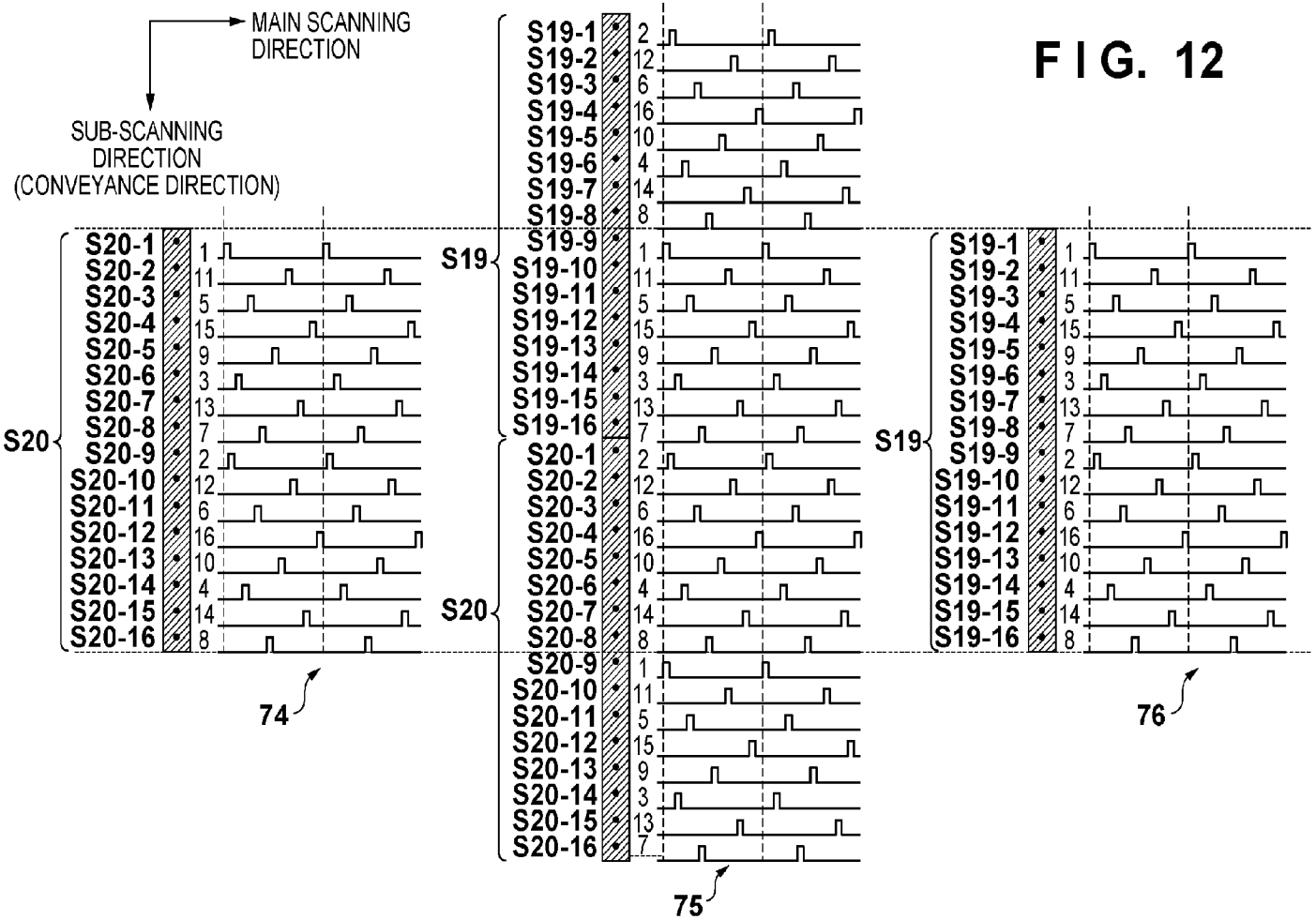
FIG. 12 is a view for explaining an outline of time divisional driving of an orifice array when printing in a region indicated by dotted lines shown in FIG. 8.
Figure 13:
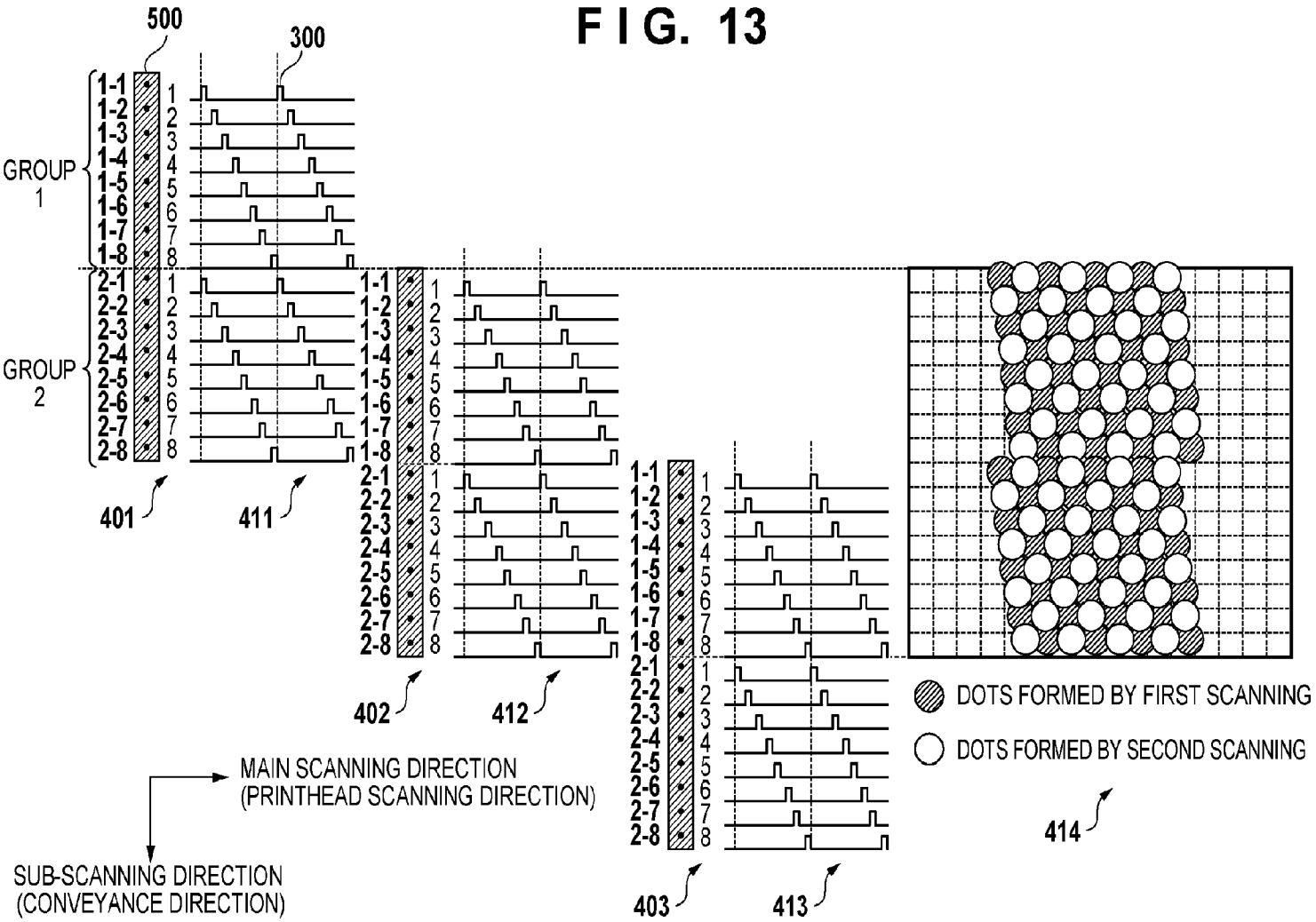
FIG. 13 is a view for explaining a conventional technique.
Figure 14:
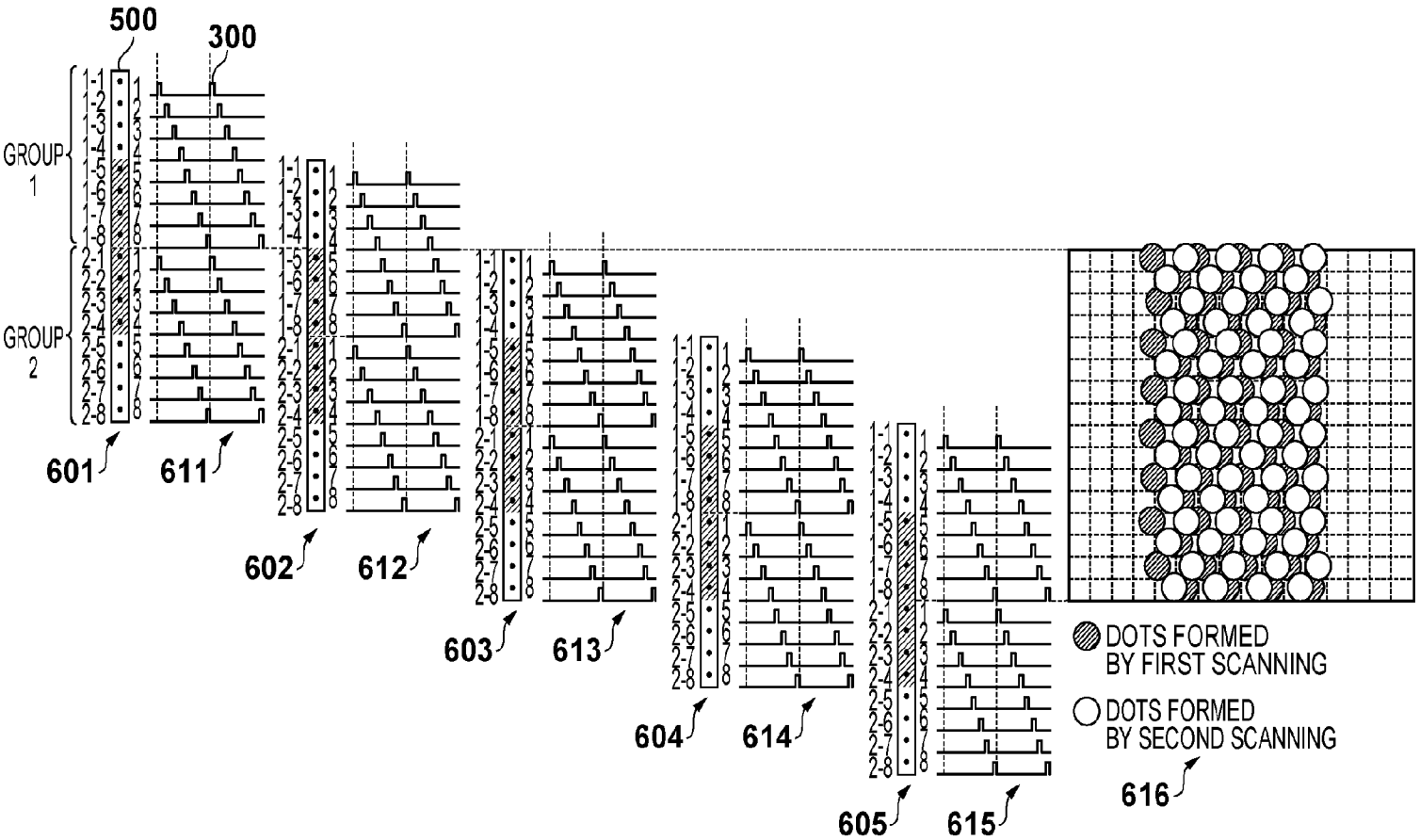
FIG. 14 is a view for explaining a conventional technique.

As shown in FIG. 1B, 12 orifice arrays 101 to 112 are arrayed in the printhead 20 according to the embodiment. The respective orifice arrays discharge inks of respective colors. The orifice arrays 101 to 112 can discharge, for example, inks of gray, photo black, light gray, dark gray, light cyan, magenta, yellow, light magenta, matte black, cyan, red, and clear. Each of the orifice arrays 101 to 112 of the respective colors is formed from, for example, two orifice arrays each including 512 orifices at a 600-dpi pitch. The two orifice arrays are shifted at half the pitch (1200-dpi interval) in the orifice array direction (sub-scanning direction). As a result, an orifice array including 1,024 orifices at the 1200-dpi interval is pseudo-formed for each color.

At each orifice, for example, an electrothermal transducer (heater) is arranged as a printing element. Each orifice discharges ink using thermal energy. In the embodiment, discharge of ink using the electrothermal transducer is described as an ink discharge method, but the ink discharge method is not limited to this. Various inkjet methods are available, including a method using a piezoelectric element, a method using an electrostatic element, and a method using a MEMS element.

Figure 2:
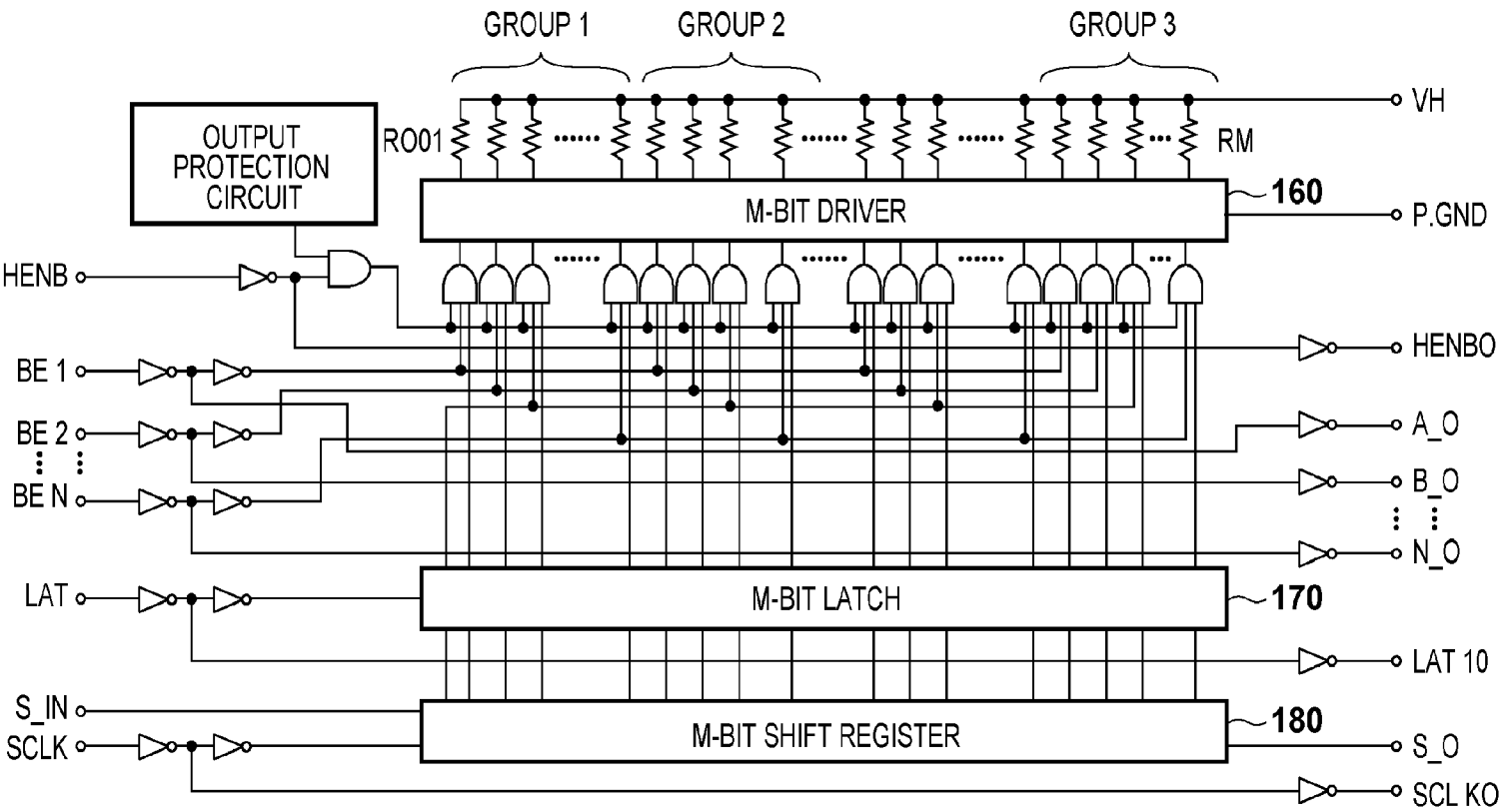
FIG. 2 is a diagram exemplifying the arrangement of the driving circuit of a printhead 20.

A plurality of orifices (printing elements) arranged in the printhead 20 are divided into groups each including a predetermined number of printing elements. The printing elements in each group are time-divisionally driven. An outline of time divisional driving in the driving circuit of the printhead 20 shown in FIG. 1B will be explained briefly with reference to FIG. 2.

M printing elements R01 to RM are commonly connected to a driving voltage VH at one end, and connected to an M-bit driver 160 at the other end. The M printing elements are divided into L groups each including N adjacent printing elements.

The M-bit driver 160 receives AND signals between an output signal from an M-bit latch 170, and N-bit block selection signals BE1 to BEN.

The M-bit latch 170 holds an M-bit signal output from an M-bit shift register 180. Upon receiving a latch signal LAT, the M-bit latch 170 latches (holds) the M-bit data held in the M-bit shift register 180.

The M-bit shift register 180 is a circuit which holds image data in correspondence with a printing signal. The M-bit shift register 180 receives image data sent via a signal line S_IN in synchronism with an image data transfer clock SCLK.

In the driving circuit having this arrangement, temporally divided driving signals are sequentially input as the N-bit (N) block enable selection signals BE1 to BEN. In response to this, the M printing elements are time-divisionally driven for N respective driving blocks each including one printing element in each group. That is, a plurality of printing elements in the printhead are divided into a plurality of driving blocks, and time-divisionally driven at timings different from each other.

Figure 3:
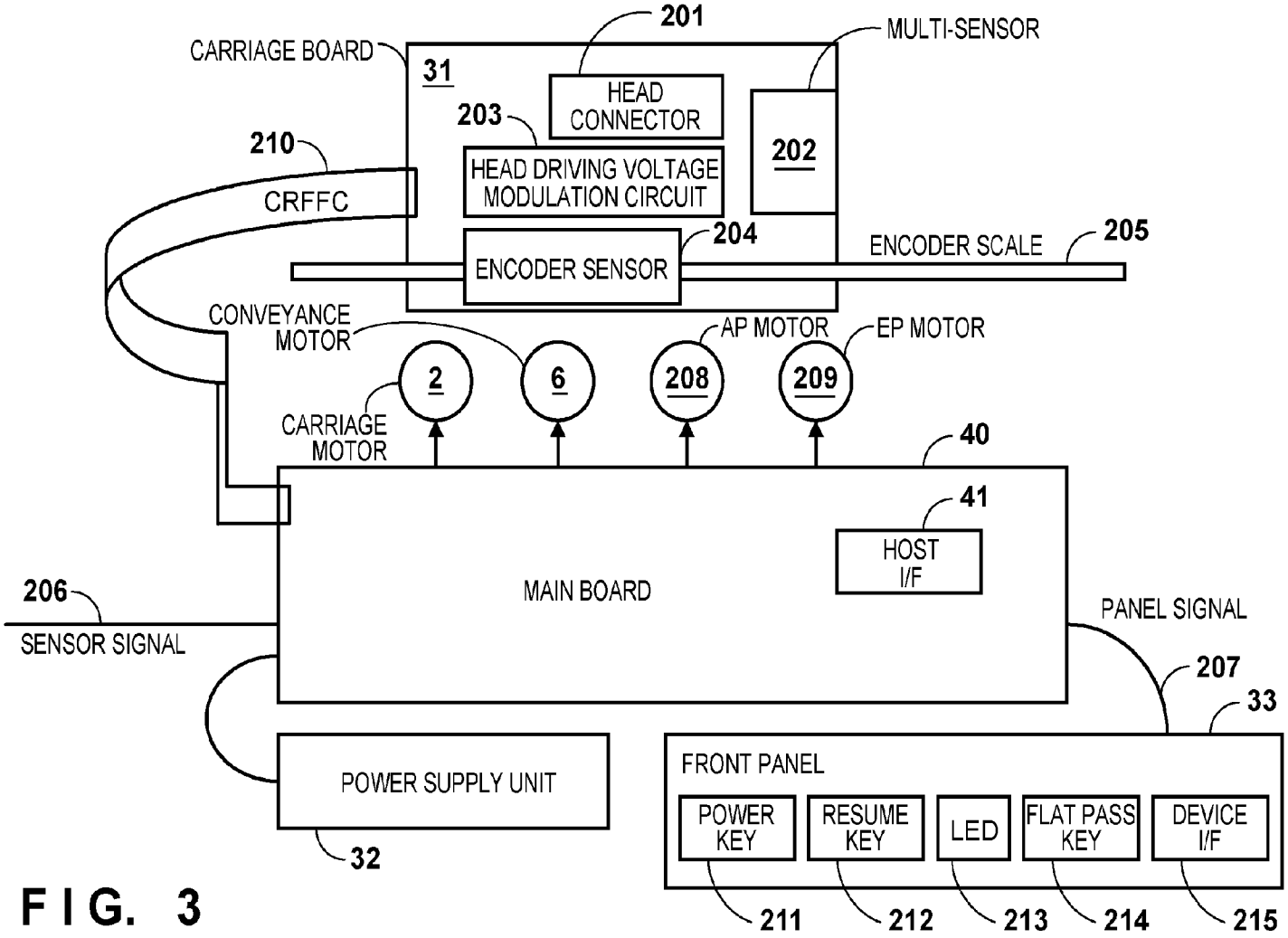
FIG. 3 is a block diagram exemplifying the arrangement (electrical circuit) of a control system in the printing apparatus 10.

The arrangement (electrical circuit) of a control system in the printing apparatus 10 shown in FIG. 1A will be exemplified with reference to FIG. 3.

The printing apparatus 10 includes, as building components of the control system, a carriage board 31, main board 40, power supply unit 32, and front panel 33.

The power supply unit 32 is connected to the main board 40, and supplies driving power to each building component.

The carriage board 31 is a board unit mounted on the carriage 1, and exchanges various signals with the printhead 20 via a head connector 201. In addition, the carriage board 31 supplies head driving power via the head connector 201. The carriage board 31 is connected to the main board 40 via a flexible flat cable (CRFFC) 210.

The carriage board 31 detects a change of the positional relationship between an encoder scale 205 and an encoder sensor 204, based on a pulse signal output from the encoder sensor 204 along with movement of the carriage 1. The carriage board 31 outputs the output signal to the main board 40 via the CRFFC 210.

The main board 40 is a board unit which performs driving control of the respective units of the printing apparatus 10. A host I/F (InterFace) 41 is arranged on the main board 40. The main board 40 receives data from a host computer (not shown) via the I/F 41, and controls various printing operations based on the data.

The main board 40 includes the carriage motor 2 serving as a driving source for moving the carriage 1, and the conveyance motor 6 serving as a driving source for conveying a printing medium. The main board 40 also includes an AP motor 208 and EP motor 209. The main board 40 also controls driving of these motors.

The main board 40 exchanges a sensor signal 206 (including a control signal and detection signal) with various sensors (for example, the encoder sensor 204) which detect the operation statuses of the respective units of the printing apparatus. The main board 40 is also connected to the CRFFC 210 and power supply unit 32.

The front panel 33 is a user interface between the user and the printing apparatus 10. The front panel 33 includes a power key 211, resume key 212, LED 213, flat pass key 214, and device I/F 215. The operation of the front panel 33 is controlled based on a panel signal 207 from the main board 40.

Figure 4:
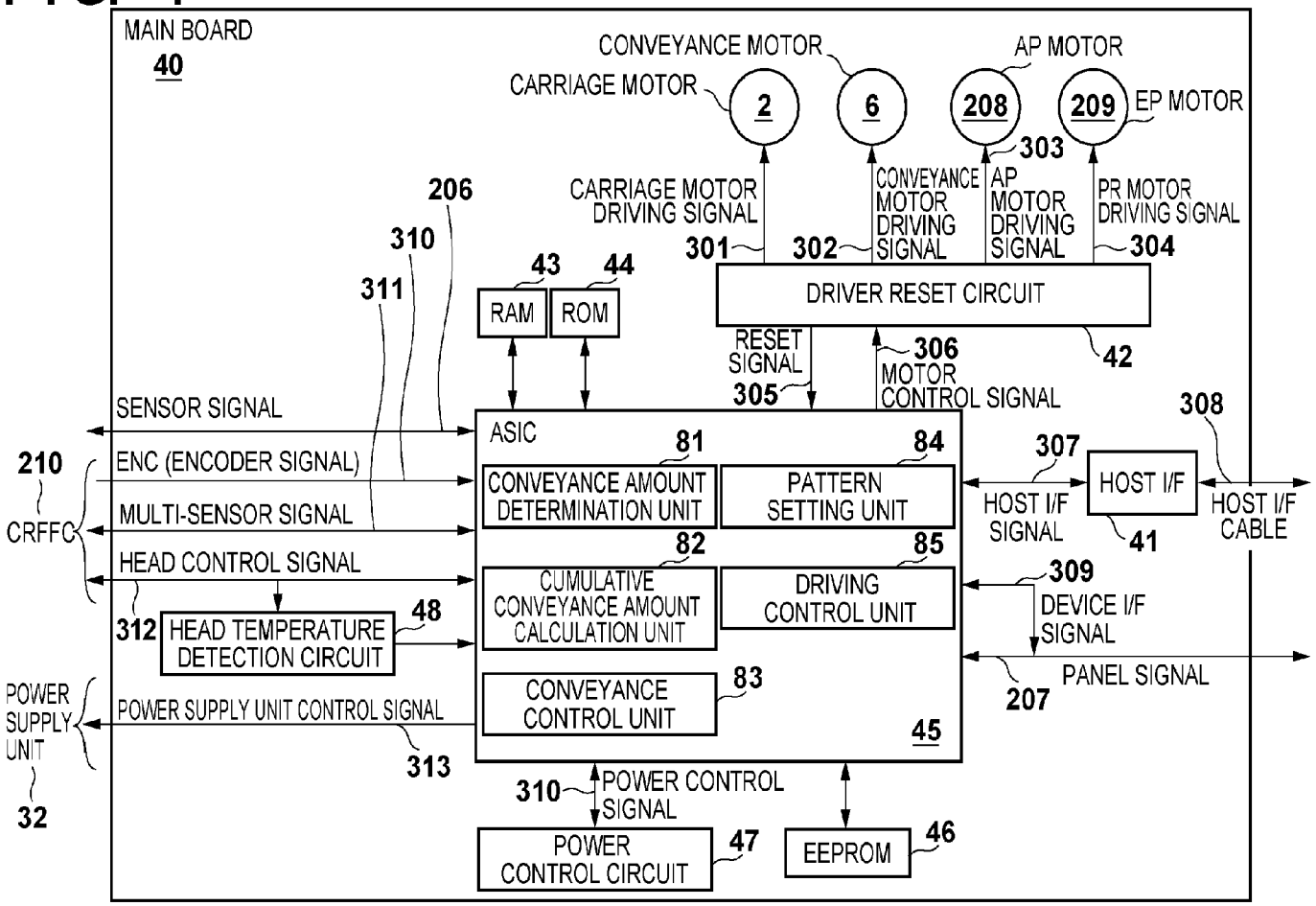
FIG. 4 is a block diagram exemplifying the internal arrangement of a main board 40 shown in FIG. 3.

The internal arrangement of the main board 40 shown in FIG. 3 will be exemplified with reference to FIG. 4.

In addition to the host I/F 41, the main board 40 includes a driver reset circuit 42, RAM 43 (Random Access Memory), ROM (Read Only Memory) 44, ASIC (Application Specific Integrated Circuit) 45, EEPROM (Electrically Erasable PROM) 46, power control circuit 47, and head temperature detection circuit 48.

The ASIC 45 is a one-chip semiconductor integrated circuit, and outputs a motor control signal 306, power control signal 310, power supply unit control signal 313, and the like. The ASIC 45 is connected to the RAM 43 and ROM 44, and performs various control operations in accordance with a program stored in the ROM 44 by using the RAM 43 as a work area. The RAM 43 is implemented by, for example, a DRAM (Dynamic Random Access Memory), and is used as a printing data buffer, a reception buffer for data from a host computer, or a work area necessary for various control operations.

The ASIC 45 exchanges the sensor signal 206 regarding various sensors, and detects, for example, the state of an encoder signal (ENC) 310. The ASIC 45 executes various logical operations, condition determination, and the like in accordance with the connection of the host I/F 41 and the data input state, controls the respective units, and controls the printing apparatus 10.

The ASIC 45 detects the state of the encoder signal (ENC) 310 to generate a timing signal, and controls the printing operation of the printhead 20 using a head control signal 312. The encoder signal (ENC) 310 is an output signal which is input from the encoder sensor 204 via the CRFFC 210.

The EEPROM 46 stores various types of information such as the printing history. For example, the ASIC 45 counts the number of dots from the respective orifices of the printhead 20 based on monitoring of the head control signal 312, and stores, as a printing history in the EEPROM 46, a numerical value obtained by calculating the accumulation. The value of the printing history is called, as needed.

The power control circuit 47 controls power supply to each sensor including a light-emitting element, and the like in accordance with the power supply control signal 310 from the ASIC 45. The head temperature detection circuit 48 detects the temperature of the printhead 20 based on the head control signal 312.

The host I/F 41 outputs a host I/F signal 307 from the ASIC 45 to a host I/F cable 308 (connected to the outside), and inputs a signal from the cable 308 to the ASIC 45.

The power supply unit 32 supplies power to the respective units based on the power supply unit control signal 313 from the ASIC 45. If necessary, the supplied power is converted into a voltage, and then supplied to the respective units inside and outside the main board 40. The power supply unit 32 shifts the printing apparatus 10 to a low power consumption mode or the like based on the power supply unit control signal 313.

The ASIC 45 includes, as functional components, a conveyance amount determination unit 81, cumulative conveyance amount calculation unit 82, conveyance control unit 83, pattern setting unit 84, and driving control unit 85.

The conveyance amount determination unit 81 determines the conveyance amount of a printing medium in each printing scan by the printhead 20. The conveyance amount is determined based on, for example, a plurality of conveyance amounts held in advance in the ROM 44 or the like. The ROM 44 or the like stores a conveyance pattern (conveyance amount) corresponding to printing using all orifices, and a conveyance pattern corresponding to printing using some orifices.

The cumulative conveyance amount calculation unit 82 calculates the cumulative conveyance amount (within a page) of a printing medium. The conveyance control unit 83 controls a conveyance unit (for example, conveyance roller and discharge roller) to convey a printing medium based on the conveyance amount determined by the conveyance amount determination unit 81. The conveyance control unit 83 controls conveyance of the printing medium using the distance (600 dpi in this case) between orifices (between printing elements) as a unit. The conveyance unit (for example, conveyance roller and discharge roller) can change the printing medium conveyance amount using 600 dpi as a unit.

The pattern setting unit 84 sets driving block patterns (driving order patterns) for respective orifices (for respective printing elements) in each group based on a conveyance amount calculated by the cumulative conveyance amount calculation unit 82. The driving block patterns represent information which defines the driving order of printing elements.

The driving control unit 85 time-divisionally drives a plurality of printing elements in accordance with driving block patterns set by the pattern setting unit 84. The functional components implemented on the ASIC 45 have been exemplified.

An outline of conveyance control of the printing medium P in the printing apparatus 10 shown in FIG. 1A will be described with reference to FIGS. 5A to 5C and 6.

Figure 5A:
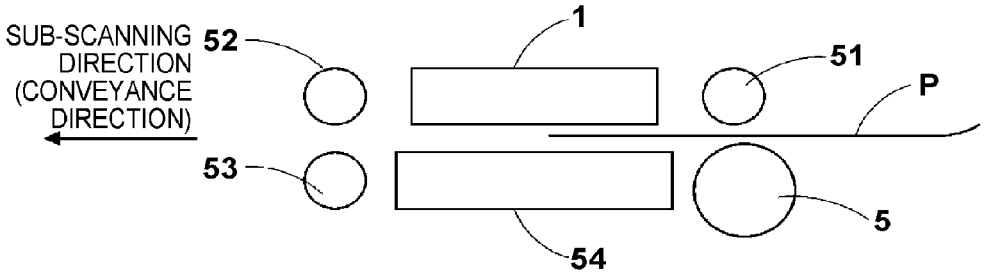
FIGS. 5A to 5C are views for explaining an outline of conveyance control in the printing apparatus 10.

When printing in a downstream region (leading end) on the printing medium P in the conveyance direction, the conveyance roller 5 and a pinch roller 51 support an upstream region (trailing end) on the printing medium in the conveyance direction, as shown in FIG. 5A. However, the downstream region (leading end) is not supported by the rollers, and the conveyance state becomes unstable.

Figure 5B:
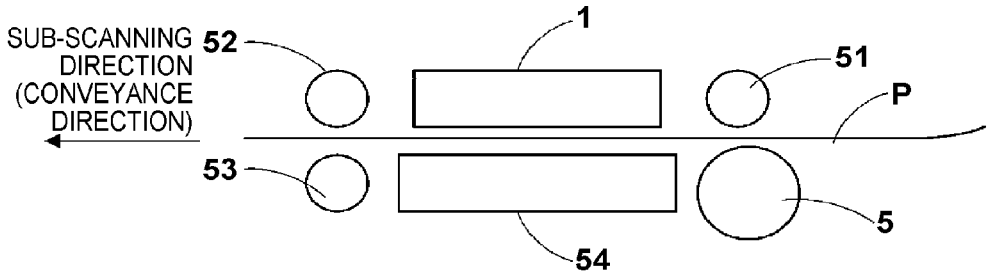

When printing in a center region on the printing medium P, the conveyance roller 5 and pinch roller 51 support the leading end region on the printing medium P, as shown in FIG. 5B. Further, a discharge roller 53 and spur roller 52 support the trailing end. That is, when printing in the center region, the printing medium is conveyed to the position of a platen 54 while its leading and trailing ends are supported by the rollers. At a position where the printing medium faces the platen 54, the carriage 1 scans to print. Hence, printing is performed on the printing medium in a stable conveyance state.

Figure 5C:
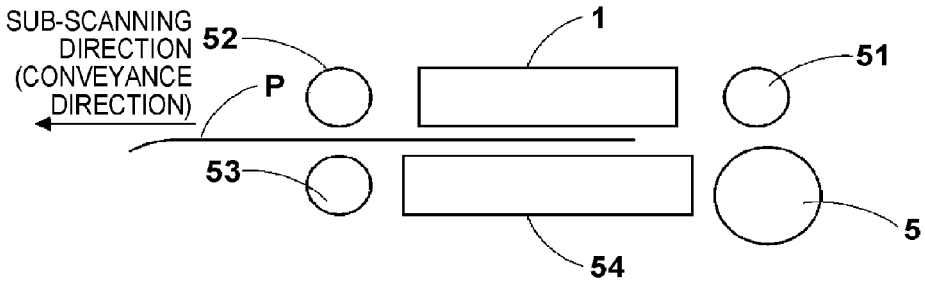

When printing on the trailing end of the printing medium P, the discharge roller 53 and spur roller 52 support the leading end region on the printing medium P, as shown in FIG. 5C. However, the trailing end region on the printing medium P is not supported by the rollers, and the conveyance state becomes unstable.

Figure 6:
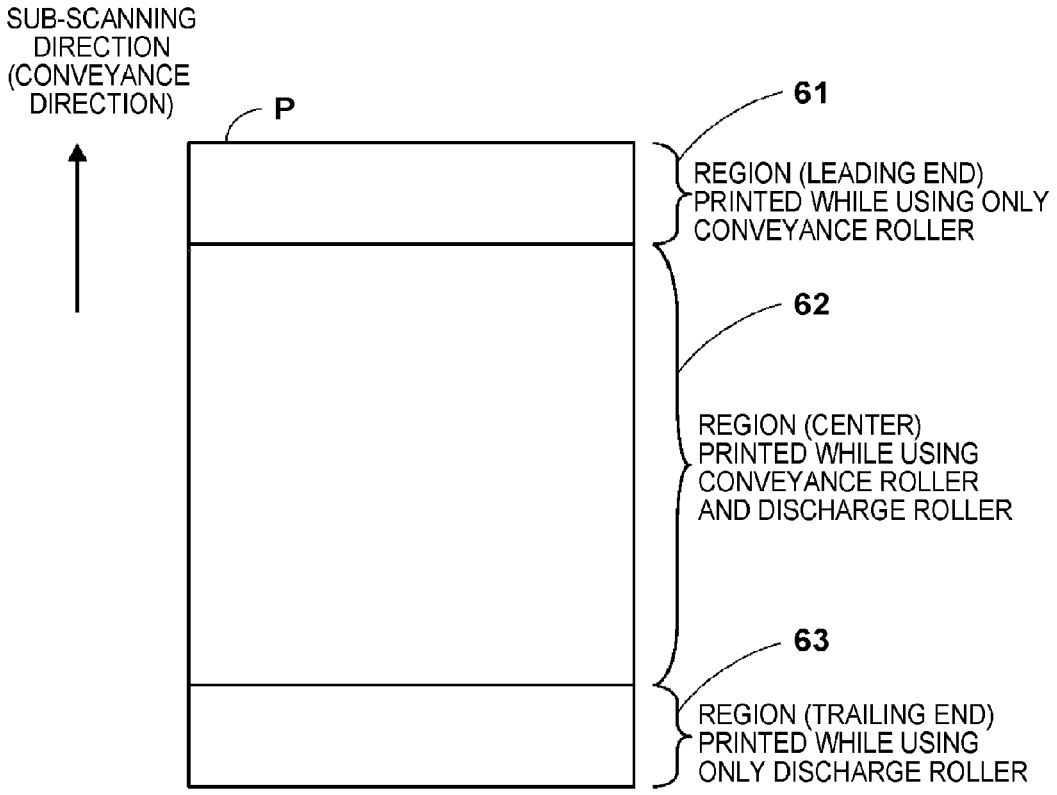
FIG. 6 is a view for explaining an outline of conveyance control in the printing apparatus 10.

In the states shown in FIGS. 5A and 5C, printing is performed on the printing medium P in an unstable conveyance state. As shown in FIG. 6, a region on a printing medium is roughly divided into three regions 61, 62, and 63. Printing is executed in a stable state only in the center region 62 among these regions.

To ensure the conveyance accuracy in printing in a region in an unstable conveyance state, the embodiment performs the printing operation using not all but only some orifices of the orifice array.

The relationship between orifices used in the printing operation and a conveyance amount in each printing scan will be explained with reference to FIGS. 7 to 9.

Figure 7:
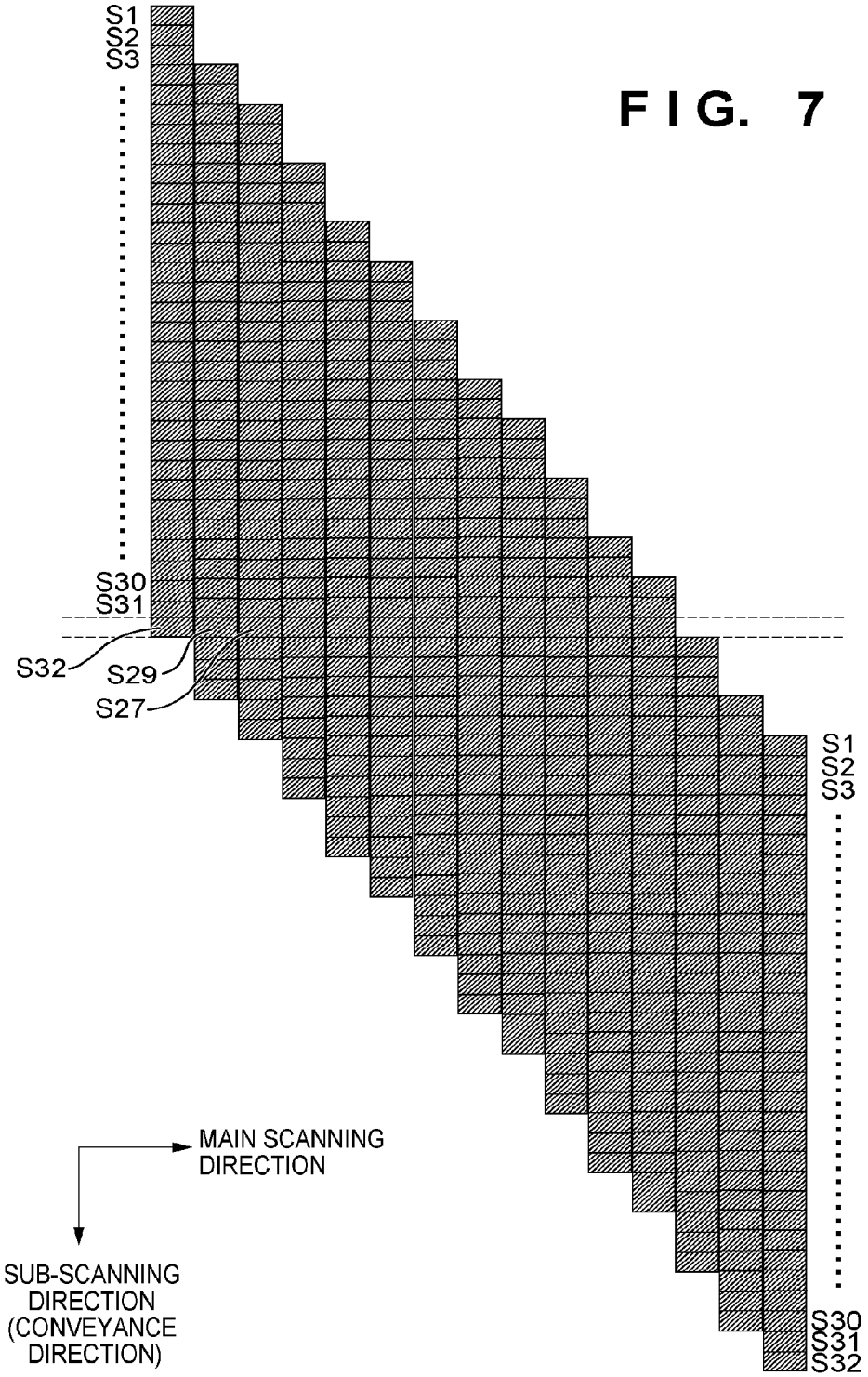
FIG. 7 is a view for explaining the relationship between orifices used in a printing operation and a conveyance amount in each printing scan.

FIG. 7 shows a state in which an image is printed using all orifices when printing in a center region on a printing medium. In FIG. 7, an orifice array formed from 512 orifices at a 600-dpi pitch on one side is divided into 32 groups S1 to S32. An orifice array on the leftmost side in FIG. 7 represents the first printing scan. An orifice array immediately adjacent to the right is positioned downstream by 48 orifices in the conveyance direction. A conveyance amount in the second printing scan will be referred to as 48 (48 orifices at the 600-dpi pitch).

When printing an image using all orifices, the printing medium P is conveyed in conveyance amounts of 48, 48, and 32 as repetitive units. Printing of an image in a predetermined region is completed by a total of 12 printing scans.

Figure 8:
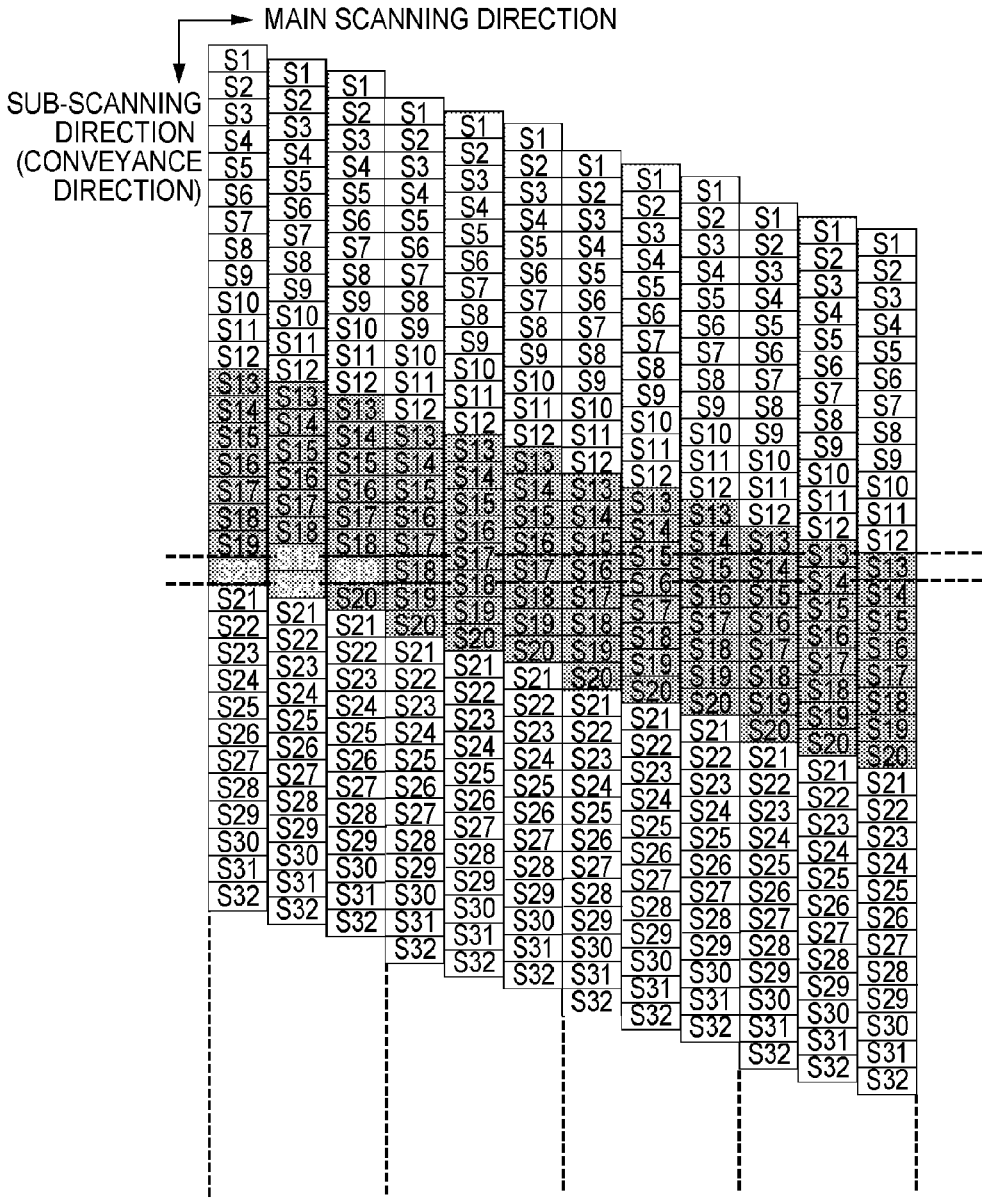
FIG. 8 is a view for explaining the relationship between orifices used in a printing operation and a conveyance amount in each printing scan.

FIG. 8 shows a state in which an image is printed using only some orifices when printing in leading and trailing end regions on a printing medium. Printing uses groups S13 to S20 corresponding to 128 orifices out of 512 orifices at the 600-dpi pitch on one side (shaded region of the orifice array in FIG. 8).

When printing an image using some orifices, the printing medium P is conveyed in conveyance amounts of 16, 8, and 8 as repetitive units. Printing of an image in a predetermined region is completed by a total of 12 printing scans.

Figure 9:
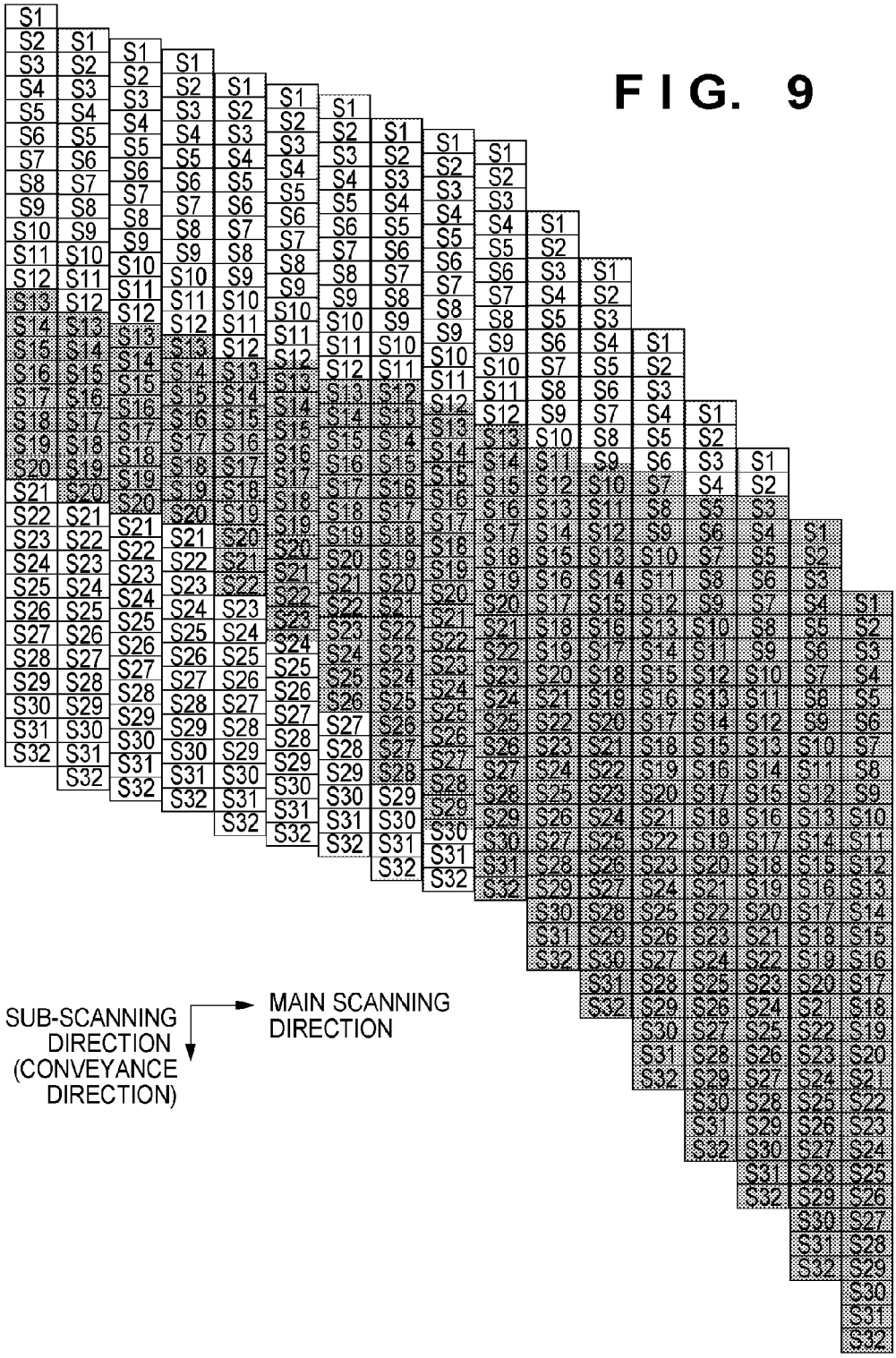
FIG. 9 is a view for explaining the relationship between orifices used in a printing operation and a conveyance amount in each printing scan.

FIG. 9 shows an intermediate state in which printing in a leading end region using only some orifices shifts to printing in a center region using all orifices. In this case, the printing medium conveyance amount and the number of orifices used in the printing operation are switched during the printing operation. More specifically, the number of orifices used in the printing operation gradually increases to print.

Figure 10:
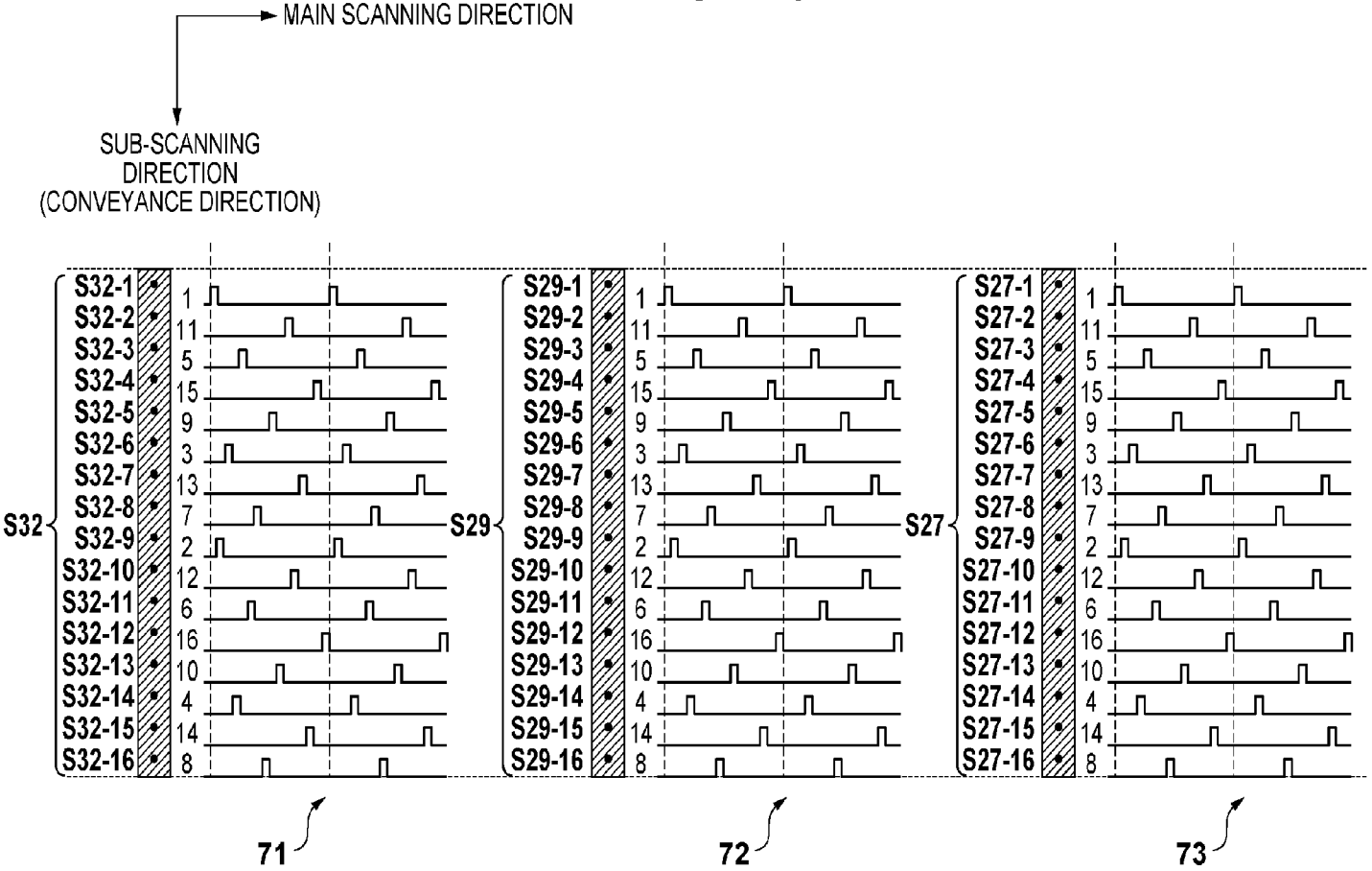
FIG. 10 is a view for explaining an outline of time divisional driving of an orifice array when printing in a region indicated by dotted lines shown in FIG. 7.

FIG. 10 is a view showing an outline of time divisional driving of an orifice array when printing in a region indicated by dotted lines shown in FIG. 7 (printing using all orifices).

Reference numeral 71 denotes an outline of time divisional driving in group S32 in the first printing scan. All orifices to be described here belong to 16 orifice groups. The discharge timing is shifted to drive orifices so that orifices in a group discharge ink at timings different from each other. As for numerals described on the left and right sides of each orifice, a numeral on the left side indicates an orifice number (for example, S32-1), and a numeral on the right side indicates a driving timing. For example, among orifices of group S32, S32-1 is the first orifice, and S32-16 is the 16th orifice. In time divisional driving denoted by reference numeral 71, the orifice S32-1 is driven at the first driving timing. The orifice S32-9 is driven at the second driving timing. That is, a plurality of orifices belonging to each group are driven in the order of patterns (driving block patterns) which define the driving order of orifices.

The embodiment executes multi-pass printing (2-pass printing in this case) in two directions in the same printing region on a printing medium. More specifically, time divisional driving operations denoted by reference numerals 71 and 73 represent forward printing scans, and a time divisional driving operation denoted by reference numeral 72 represents a reverse printing scan. In the forward printing scan, a block selection signal is generated to drive orifices in the order of the first driving timing, second driving timing, . . . , 16 driving timing in accordance with the driving block patterns shown in FIG. 10, thereby discharging ink onto a printing medium. In the reverse printing scan, a block selection signal is generated to drive orifices in the order of the 16th driving timing, 15th driving timing, . . . , first driving timing in accordance with the driving block patterns shown in FIG. 10, thereby discharging ink onto the printing medium.

Figure 11:
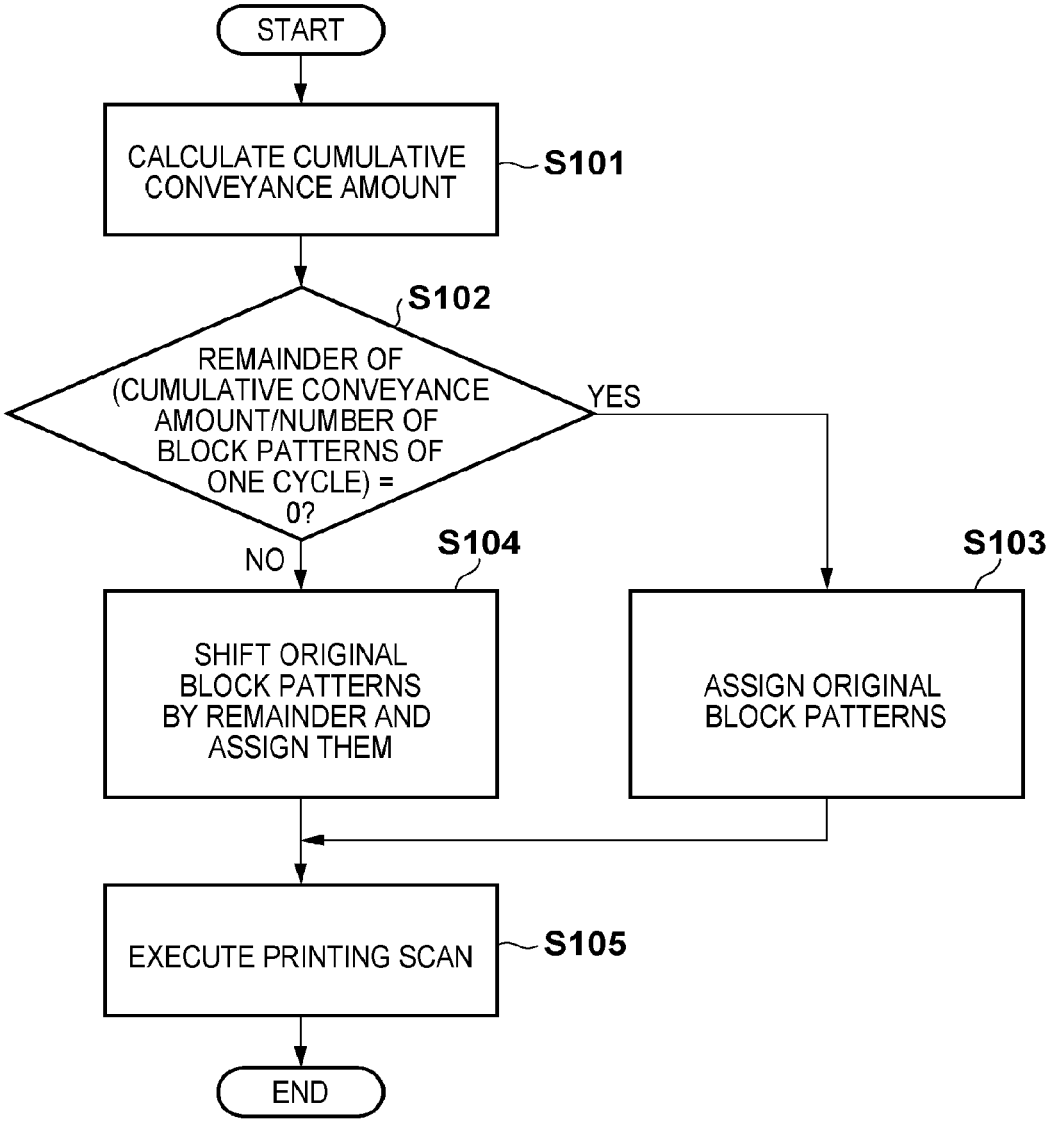
FIG. 11 is a flowchart exemplifying a processing sequence in the printing apparatus 10.

A time divisional driving processing sequence in the printing operation shown in FIG. 10 will be described with reference to FIG. 11. More specifically, a processing sequence when setting patterns (driving block patterns) which define the driving order of orifices will be explained. As described above, when printing using all orifices, the printing medium P is conveyed in conveyance amounts of 48, 48, and 32 as repetitive units.

Note that the driving block patterns are common to all groups in the same printing scan. In the second printing scan, orifices of a group (group S29 in FIG. 10) different from that in the first printing scan print in the same printing region on the printing medium. Driving block patterns at this time are determined at the start of a printing scan.

The printing apparatus 10 controls the cumulative conveyance amount calculation unit 82 to calculate a cumulative conveyance amount (step S101). The cumulative conveyance amount unit a total conveyance amount from the first printing scan of a target page, and is calculated for the number (16 in this case) of orifices of one group as a unit.

In the embodiment, the conveyance amount is calculated at every 600 dpi. Assume that a cumulative conveyance amount in a printing scan denoted by reference numeral 71 is 16N (N is an integer). Then, a cumulative conveyance amount at the time (second printing scan) denoted by reference numeral 72 is a value obtained by adding, to the cumulative conveyance amount up to the time denoted by reference numeral 71, a conveyance amount of 48 from reference numeral 71 to reference numeral 72, that is, 16N+48.

Subsequently, the printing apparatus 10 controls the pattern setting unit 84 to calculate a remainder by dividing the cumulative conveyance amount of 16N+48 at this time by the number of driving block patterns of one cycle. In the embodiment, one cycle of driving block patterns is set for one group, one group includes 16 orifices, and thus the number of driving block patterns of one cycle is 16. Hence, "(16N+48)/16", and the remainder is 0.

Since the remainder is 0 (YES in step S102), the printing apparatus 10 controls the pattern setting unit 84 to assign block numbers to respective orifices belonging to a target group (group S29) in accordance with original driving block patterns (step S103). In the second printing scan, a printing scan is executed using the original driving block patterns, similar to the printing scan denoted by reference numeral 71 (step S105).

In the third printing scan, printing is performed in the same printing region on the printing medium using orifices belonging to group S27. Driving block patterns at this time are set in the above-described way. In this case, the cumulative conveyance amount is a value obtained by adding, to the cumulative conveyance amount (16N+48) up to the time denoted by reference numeral 72, a conveyance amount of 32 from reference numeral 72 to reference numeral 73, that is, 16N+80.

The printing apparatus 10 controls the pattern setting unit 84 to calculate a remainder by dividing the cumulative conveyance amount of 16N+80 by the number (16 in this case) of block patterns of one cycle. More specifically, "(16N+80)/16", and the remainder is 0.

Since the remainder is 0 (YES in step S102), the printing apparatus 10 controls the pattern setting unit 84 to assign block numbers to respective orifices belonging to a target group (group S27) in accordance with original driving block patterns (step S103). In the third printing scan (reference numeral 73), a printing scan is executed using the original driving block patterns, similar to the printing scan denoted by reference numeral 71 (step S105).

As described above, when printing using all orifices, conveyance amounts of 48, 48, and 32 serve as repetitive units. For this reason, the original driving block patterns are used in all 12 printing scans which are repeated in a region to be printed on a printing medium.

FIG. 12 shows the state of time divisional driving of an orifice array when printing in a region indicated by dotted lines shown in FIG. 8 (printing using some orifices). A time divisional driving processing sequence in the printing operation shown in FIG. 12 will be described with reference to FIG. 11. As described above, when printing using some orifices, conveyance amounts of 16, 8, and 8 serve as repetitive units in conveyance of the printing medium P. As for numerals described on the left and right sides of each orifice, a numeral on the left side indicates an orifice number (for example, S20-1), and a numeral on the right side indicates a driving timing, similar to FIG. 10.

In the second printing scan denoted by reference numeral 75 in FIG. 12, printing is performed in the same printing region on a printing medium using orifices S19-9 to S19-16 of the lower half of group S19 and orifices S20-1 to S20-8 of the upper half of group S20.

The printing apparatus 10 controls the cumulative conveyance amount calculation unit 82 to calculate a cumulative conveyance amount (step S101). Assume that a cumulative conveyance amount in a printing scan denoted by reference numeral 74 is 16N (N is an integer). Then, a cumulative conveyance amount at the time (second printing scan) denoted by reference numeral 75 is a value obtained by adding, to the cumulative conveyance amount up to the time denoted by reference numeral 74, a conveyance amount of 8 from reference numeral 74 to reference numeral 75, that is, 16N+8.

The printing apparatus 10 controls the pattern setting unit 84 to calculate a remainder by dividing the cumulative conveyance amount of 16N+8 by the number (16 in this case) of driving block patterns of one cycle. More specifically, "(16N+8)/16", and the remainder is 8.

Since the remainder is 8 (NO in step S102), the printing apparatus 10 controls the pattern setting unit 84 to shift the driving block patterns by the remainder of 8, and assign block numbers to respective orifices belonging to target groups (step S104).

More specifically, block numbers different from those of the original driving block patterns are set for orifices belonging to groups S19 and S20, as denoted by reference numeral 75.

When the original driving block patterns are set, the driving order is set in the order of "1, 11, 5, 15, 9, 3, 13, 7, 2, 12, 6, 16, 10, 4, 14, 8" from the top orifice in the group, as denoted by reference numeral 74.

In contrast, the driving block patterns are shifted by eight orifices and assigned, as denoted by reference numeral 75. The driving order is set in the order of "2, 12, 6, 16, 10, 4, 14, 8, 1, 11, 5, 15, 9, 3, 13, 7".

In the third printing scan, printing is performed using orifices belonging to group S19 in the same printing region on the printing medium. Driving block patterns at this time are set by the above-described processing. In this case, the cumulative conveyance amount is a value obtained by adding, to the cumulative conveyance amount (16N+8) up to the time denoted by reference numeral 75, a conveyance amount of 8 from reference numeral 75 to reference numeral 76, that is, 16N+16.

The printing apparatus 10 controls the pattern setting unit 84 to calculate a remainder by dividing the cumulative conveyance amount of 16N+16 by the number (16 in this case) of driving block patterns of one cycle. More specifically, "(16N+16)/16", and the remainder is 0.

Since the remainder is 0 (YES in step S102), the printing apparatus 10 controls the pattern setting unit 84 to assign block numbers to respective orifices belonging to a target group (group S19) in accordance with original driving block patterns (step S103). In the third printing scan (reference numeral 76), a printing scan is executed using the original driving block patterns, similar to the printing scan denoted by reference numeral 74 (step S105). In this case, the original driving block patterns are set as driving block patterns. The driving order is set in the order of "1, 11, 5, 15, 9, 3, 13, 7, 2, 12, 6, 16, 10, 4, 14, 8" from the top orifice in the group.

As described above, according to the embodiment, when printing in the same printing region on a printing medium by multi-pass printing, driving block patterns are set to time-divisionally drive respective printing elements in the same driving order in respective printing scans. In other words, the driving orders of a plurality of printing elements used in printing in respective printing scans coincide with each other.

This can prevent degradation of image uniformity caused by disturbance of the layout position of a dot formed on a printing medium when the printing medium conveyance amount does not coincide with an integer multiple of the number of driving block patterns of one cycle. The printing quality can therefore be improved.

A typical embodiment of the present invention has been exemplified. However, the present invention is not limited to the above-described embodiment illustrated in the drawings, and can be properly modified without departing from the scope of the invention.

For example, in the above-described embodiment, the number of driving block patterns of one cycle is 16, and printing medium conveyance amounts are "48, 48, 32" or "16, 8, 8". However, the present invention is not limited to them. That is, a combination of the number of driving block patterns and conveyance amounts is arbitrary.

For example, in the above-described embodiment, the driving block patterns are shifted based on the printing medium conveyance amount. However, the present invention is not limited to this. The embodiment can adopt any method as long as the driving orders of a plurality of printing elements used in printing in respective printing scans of the same printing region coincide with each other when performing multi-pass printing in the same printing region on a printing medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-224307, filed Oct. 11, 2011, which is hereby incorporated by reference herein in its entirety.

What is claimed is:

1. A printing apparatus comprising:

a printhead including an element array in which a plurality of printing elements, for applying ink to a printing medium so as to print an image on the printing medium, are arrayed;

a scanning unit configured to scan said printhead in a direction perpendicular to an array direction of the plurality of printing elements;

a conveyance unit configured to convey the printing medium in the array direction of the plurality of printing elements, wherein a scan of the printhead by the scanning unit and a conveyance of the printing medium by the conveyance unit are alternately performed such that an image is printed in a predetermined printing region by a plurality of scans;

a driving unit configured to drive the plurality of printing elements such that printing elements in each of a plurality of groups are driven in a set driving order, wherein the plurality of printing elements are divided into the plurality of groups each including consecutive printing elements;

an obtaining unit configured to obtain, after a first scan is performed for the predetermined printing region, information, wherein the information indicates whether or not a position of printing elements which is used in a second scan for the predetermined printing region in the group to which the printing elements used in the second scan belong, coincides with a position of printing elements which is used in the first scan in the group to which the printing elements used in the first scan belong; and a setting unit configured to set the driving order for the printing elements in each of the plurality of groups, wherein said conveyance unit performs a first conveyance operation of conveying the printing medium for printing on a first area of the printing medium by a conveyance amount, which is an integer multiple of an amount corresponding to a width of the group, and a second conveyance operation of conveying the printing medium for printing on a second area of the printing medium by a conveyance amount, which is not an integer multiple of the width of the group, and wherein said setting unit sets, for the second scan, the driving order for the printing elements in each of the plurality of groups, based on the information obtained by the obtaining unit.

2. The apparatus according to claim 1, wherein said setting unit sets the driving order for the printing elements in each of the plurality of groups, so as to make driving orders in respective scans of a same printing region coincide with each other, based on the information obtained by the obtaining unit.

3. The apparatus according to claim 1, wherein said setting unit sets the driving order in each scan by changing driving order patterns for determining the driving order, to shift in the array direction of the printing elements.

4. The apparatus according to claim 1, further comprising a calculation unit configured to calculate a cumulative conveyance amount of one printing medium conveyed by said conveyance unit, wherein said setting unit sets the driving order based on the cumulative conveyance amount calculated by the calculation unit.

5. The apparatus according to claim 4, wherein said obtaining unit obtains a result obtained by dividing the cumulative conveyance amount calculated by the calculation unit by an amount corresponding to the width of the group.

6. The apparatus according to claim 5, wherein said setting unit sets the driving order in each scan by changing driving order patterns for determining the driving order, to shift in the array direction of the printing elements, and the shift amounts of the driving order patterns are based on the result obtained by the obtaining unit.

7. The apparatus according to claim 1, wherein said conveyance unit includes:

a first conveyance unit, arranged upstream of said printhead in a conveyance direction, for conveying a printing medium, and a second conveyance unit, arranged downstream of said printhead in the conveyance direction, for conveying a printing medium.

8. The apparatus according to claim 7, wherein said conveyance unit makes different a printing medium conveyance amount when both said first conveyance unit and said second conveyance unit are used, from a printing medium conveyance amount when one of said first conveyance unit and said second conveyance unit is used.

9. The apparatus according to claim 1, wherein the printing element includes an electrothermal transducer for generating thermal energy for discharging ink.

10. The apparatus according to claim 1, wherein when the position of the printing elements used in the second scan in the group to which the printing elements used in the second scan belong, coincides with the position of the printing elements used in the first scan in the group to which the printing elements used in the first scan belong, the setting unit sets the driving order based on an original driving order pattern, and when the position of the printing elements used in the second scan in the group to which the printing elements used in the second scan belong, does not coincide with the position of the printing elements used in the first scan in the group to which the printing elements used in the first scan belong, the setting unit sets the driving order based on a pattern which is obtained by shifting the original driving order pattern in the array direction of the plurality of printing elements.

11. A printing apparatus comprising:

a printhead including an element array in which a plurality of printing elements, for applying ink to a printing medium so as to print an image on the printing medium, are arrayed;

a scanning unit configured to scan said printhead in a direction perpendicular to an array direction of the plurality of printing elements;

a conveyance unit configured to convey the printing medium in the array direction of the plurality of printing elements, wherein a scan of the printhead by the scanning unit and a conveyance of the printing medium by the conveyance unit are alternately performed such that an image is printed in a predetermined printing region by a plurality of scans;

a driving unit configured to drive the plurality of printing elements such that printing elements in each of a plurality of groups are driven in a set driving order, wherein the plurality of printing elements are divided into the plurality of groups each including consecutive printing elements; and a setting unit configured to set the driving order for the printing elements in each of the plurality of groups, wherein a conveyance amount of the printing medium by said conveyance unit is smaller than an amount corresponding to a width of the group, and wherein said setting unit sets the driving order for the printing elements of each of the plurality of groups for each scan, based on the conveyance amount by said conveyance unit.

12. The apparatus according to claim 11, wherein said setting unit sets the driving order for the printing elements in each of the plurality of groups, so as to make driving orders in respective scans of a same printing region coincide with each other, based on the conveyance amount.

13. The apparatus according to claim 11, wherein said setting unit sets the driving order in each scan by changing driving order patterns for determining the driving order, to shift in the array direction of the printing elements.

14. The apparatus according to claim 11, further comprising a calculation unit configured to calculate a cumulative conveyance amount of one printing medium conveyed by said conveyance unit, wherein said setting unit sets the driving order based on the cumulative conveyance amount calculated by the calculation unit.

15. The apparatus according to claim 14, wherein said setting unit sets the driving order, based on a result obtained by dividing the cumulative conveyance amount calculated by the calculation unit by an amount corresponding to the width of the group.

16. The apparatus according to claim 11, wherein said conveyance unit includes:

a first conveyance unit, arranged upstream of said printhead in a conveyance direction, for conveying a printing medium, and a second conveyance unit, arranged downstream of said printhead in the conveyance direction, for conveying a printing medium.

17. The apparatus according to claim 16, wherein said conveyance unit makes different a printing medium conveyance amount when both said first conveyance unit and said second conveyance unit are used, from a printing medium conveyance amount when one of said first conveyance unit and said second conveyance unit is used.

18. The apparatus according to claim 11, wherein the printing element includes an electrothermal transducer for generating thermal energy for discharging ink.

* * * * *